US010781595B2

(12) United States Patent
McIntosh et al.

(10) Patent No.: US 10,781,595 B2
(45) Date of Patent: Sep. 22, 2020

(54) MODULAR FLOORING ASSEMBLIES

(71) Applicant: CoMc, LLC, Omaha, NE (US)

(72) Inventors: Jonathan McIntosh, Omaha, NE (US); Rick Heib, Fort Calhoun, NE (US); Chris Wurtele, Omaha, NE (US); Steve Neubaum, Omaha, NE (US)

(73) Assignee: CoMc, LLC, Omaha, NE (US)

( * ) Notice: Subject to any disclaimer, the term of this patent is extended or adjusted under 35 U.S.C. 154(b) by 377 days.

(21) Appl. No.: 15/758,745

(22) PCT Filed: Sep. 9, 2016

(86) PCT No.: PCT/US2016/050940

§ 371 (c)(1),
(2) Date: Mar. 9, 2018

(87) PCT Pub. No.: WO2017/044739

PCT Pub. Date: Mar. 16, 2017

(65) Prior Publication Data

US 2020/0232227 A1 Jul. 23, 2020

Related U.S. Application Data

(60) Provisional application No. 62/217,012, filed on Sep. 10, 2015, provisional application No. 62/217,799, filed on Sep. 11, 2015.

(51) Int. Cl.

| | |
|---|---|
| ***E04F 15/02*** | (2006.01) |
| ***E04F 15/08*** | (2006.01) |
| ***E04F 15/04*** | (2006.01) |

(52) U.S. Cl.
CPC .... *E04F 15/02194* (2013.01); *E04F 15/0215* (2013.01); *E04F 15/04* (2013.01); *E04F 15/08* (2013.01); *E04F 2201/022* (2013.01)

(58) Field of Classification Search
CPC . E04F 15/02194; E04F 15/0215; E04F 15/04; E04F 15/08; E04F 2201/022; E04F 15/105; E04F 15/02038
See application file for complete search history.

(56) References Cited

U.S. PATENT DOCUMENTS 6,505,444 B1 * 1/2003 Johnson ..... A47L 23/24 52/177
7,197,855 B2 4/2007 Della Peppa
(Continued)

FOREIGN PATENT DOCUMENTS

| | | |
|---|---|---|
| EP | 2351897 A1 | 8/2011 |
| EP | 2354372 A1 | 8/2011 |
| WO | 2013/156626 A1 | 10/2013 |

*Primary Examiner* — Brian D Mattei
(74) *Attorney, Agent, or Firm* — Edwin A. Sisson, Attorney at Law, LLC; Jeffrey J. Banyas

(57) ABSTRACT

Disclosed herein is a modular flooring assembly including a flooring component adhered to a first tray substrate and a second tray substrate which are interconnected to form an assembled tray substrate. The assembled tray substrate may be interconnected with additional assembled tray substrates to form a modular floor suitable for most flooring applications. The flooring component may be tile or wood or other materials commonly used in flooring applications. Convention fill-in grout or a snap-in grout may be used with the modular flooring assemblies.

20 Claims, 8 Drawing Sheets

(56) References Cited

U.S. PATENT DOCUMENTS

| | | | | |
|---|---|---|---|---|
| 8,782,989 | B2 | 7/2014 | Tang | |
| 2007/0094969 | A1 | 5/2007 | McIntosh et al. | |
| 2010/0300027 | A1* | 12/2010 | Bravo | E04F 15/087 52/311.1 |
| 2010/0313509 | A1* | 12/2010 | McIntosh | E04F 15/087 52/385 |
| 2012/0304566 | A1 | 12/2012 | Thrush et al. | |
| 2012/0317911 | A1* | 12/2012 | Huang | E04F 15/02 52/309.1 |
| 2012/0324816 | A1* | 12/2012 | Huang | E04B 5/02 52/311.2 |
| 2016/0016377 | A1* | 1/2016 | Ford et al. | |
| 2017/0326810 | A1* | 11/2017 | Neill | B32B 27/08 |
| 2018/0080235 | A1* | 3/2018 | Downey | B32B 5/20 |

* cited by examiner

MODULAR FLOORING ASSEMBLIES

PRIORITY AND CROSS REFERENCES

This Application claims priority from International Application No. PCT/US2016/050940 filed on 9 Sep. 2016, United States Provisional Application No. 62/217,799 filed on 11 Sep. 2015, and United States Provisional Application No. 62/217,012 filed on 10 Sep. 2015, the teachings of each of which are hereby incorporated by reference in their entirety.

BACKGROUND

United States Patent Publication No. 2007/009469 ("US '469") teaches the use of a tray substrate and a flooring component to create a floating tile structure. The trays interlock with each other as demonstrated in FIG. 17 in US '469. U.S. Pat. No. 7,197,855 ("US '855") teaches the use of a tray substrate with a flooring component attached that is interlocked as well.

Both US '469 and US '855 provide for interlocks between the tray that completely extend from the side of the tray. Generally, these interlocks set the size of the gap between the trays.

U.S. Pat. No. 8,782,989 ("US '989") describes interlocks in which a portion of the interlock is recessed under the tray surface. By recessing a portion of the interlock under the tray surface, US '989 reduces the gap between trays.

The systems described in US '469, US '855 provides for tray substrates for use with standard sized flooring components. However, the tray substrates are not adapted for use with flooring components having non-standard sizes and/or shapes such as large rectangular or plank flooring components.

There exists, therefore, a need for a tray substrate system which can provide strength and size of the interlocking mechanism and small gaps between tiles while using non-standard sized and/or shaped flooring components such as large rectangular or plank flooring components.

FIELD OF INVENTION

This specification describes a modular flooring assembly including a rectangular flooring component adhered to two tray substrates.

SUMMARY

Figure 1:
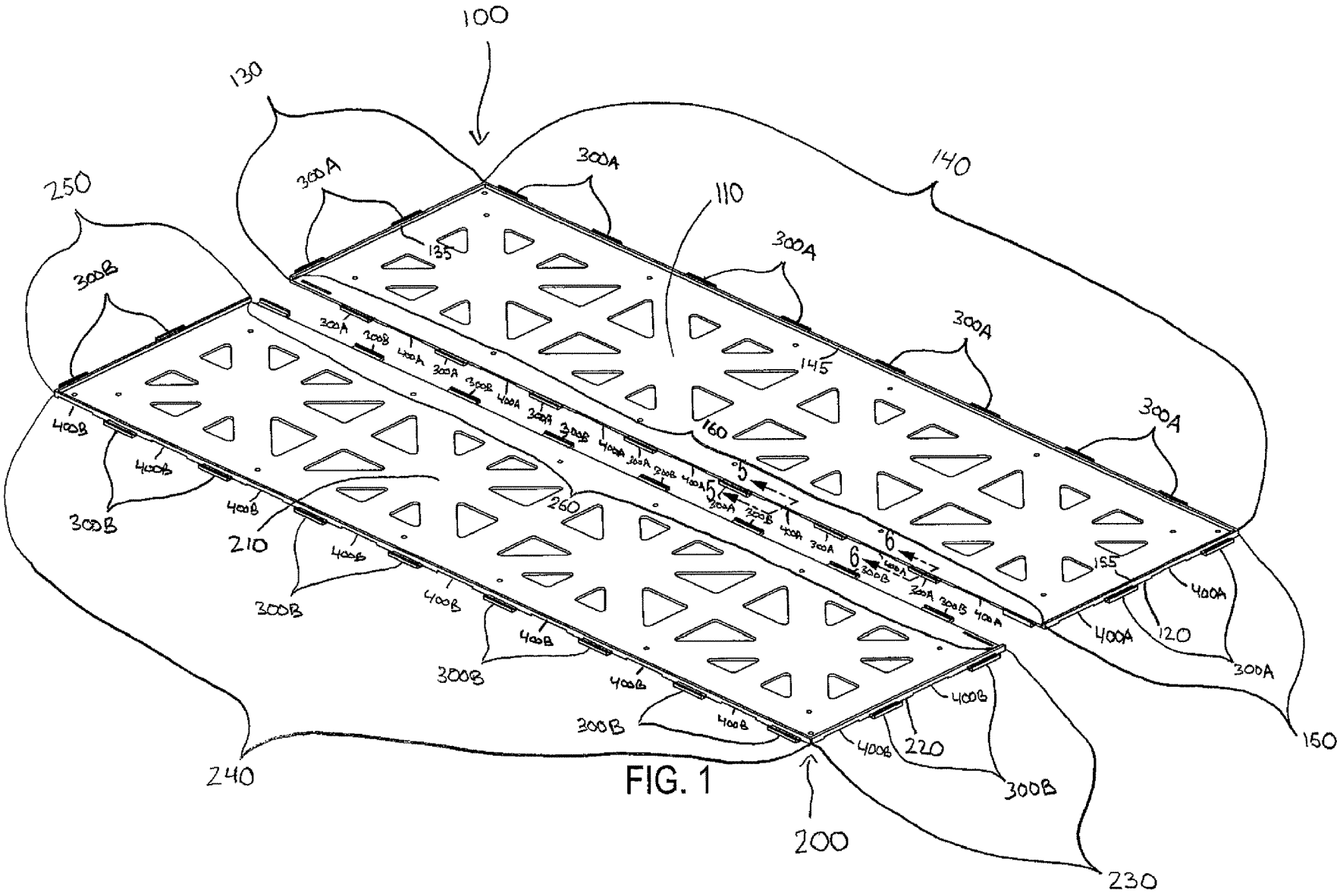
FIG. 1 is a perspective view of a first tray substrate and a second tray substrate.

Disclosed herein is a component of a flooring system comprising a flooring component; an adhesive; a first tray substrate having a first tray substrate upward facing horizontal surface, a first tray substrate bottom and a first tray substrate perimeter; and a second tray substrate having a second tray substrate upward facing horizontal surface, a first tray substrate bottom and a first tray substrate perimeter.

The first tray substrate perimeter comprises a first tray substrate first edge comprising a first tray substrate first vertical tray edge protruding upward, a first tray substrate second edge comprising a first tray substrate second vertical tray edge which protrudes upward, a first tray substrate third edge comprising a first tray substrate third vertical tray edge which protrudes upward, a first tray substrate forth edge, a plurality of first tray substrate upward tabs located on the first tray substrate forth edge and at least one of the first tray substrate first edge, the first tray substrate second edge and the first tray substrate third edge wherein each of the plurality of first tray substrate upward tabs has a convex surface extending upwardly and a valley, a plurality of first tray substrate downward tabs located on the first tray substrate forth edge and at least one of the first tray substrate first edge, the first tray substrate second edge and the first tray substrate third edge wherein each of the plurality of first tray substrate downward tabs has a concave surface and a lip and a portion of each of the plurality of first tray substrate downward tabs is recessed under the first tray substrate upward facing horizontal tray surface, a first tray substrate hole passing through the first tray substrate from the first tray substrate surface to the first tray substrate bottom located along a portion of the first tray substrate forth edge adjacent to the first tray substrate first edge, and a first tray substrate upward end tab located along a portion of the first tray substrate forth edge adjacent to the first tray substrate third edge wherein the first tray substrate upward end tab has a convex surface extending upwardly and a valley wherein the convex surface of the first tray substrate upward end tab extends upwardly by a greater amount than the convex surface of the plurality of first tray substrate upward tabs.

The second tray substrate perimeter comprises a second tray substrate first edge comprising a second tray substrate first vertical tray edge which protrudes upward, a second tray substrate second edge comprising a second tray substrate second vertical tray edge which protrudes upward, a second tray substrate third edge comprising a second tray substrate third vertical tray edge which protrudes upward, a second tray substrate forth edge, a plurality of second tray substrate upward tabs located on at least one of the second tray substrate first edge, the second tray substrate second edge and the second tray substrate third edge wherein each of the plurality of second tray substrate upward tabs has a convex surface extending upwardly and a valley, a plurality of second tray substrate downward tabs located on the second tray substrate forth edge and at least one of the second tray substrate first edge, the second tray substrate second edge and the second tray substrate third edge wherein each of the plurality of second tray substrate downward tabs has a concave surface and a lip and a portion of each of the plurality of second tray substrate downward tabs is recessed under the second tray substrate upward facing horizontal tray surface, a second tray substrate hole passing through the second tray substrate from the second tray substrate surface to the second tray substrate bottom located along a portion of the second tray substrate forth edge adjacent to the second tray substrate first edge, and a second tray substrate upward end tab located along a portion of the second tray substrate forth edge adjacent to the second tray substrate third edge wherein the second tray substrate upward end tab has a convex surface extending upwardly and a valley wherein the convex surface of the second tray substrate upward end tab extends upwardly by a greater amount than the convex surface of the plurality of second tray substrate upward tabs.

The first tray substrate is connected to the second tray substrate by an interaction between the first tray substrate hole and the second tray substrate upward end tab, an interaction between the second tray substrate hole and a first tray substrate upward end tab, an interaction between the plurality of first tray substrate upward tabs located on the first tray substrate forth edge and the plurality of second tray substrate downward tabs located on the second tray substrate forth edge, and an interaction between the plurality of second tray substrate upward tabs located on the second tray substrate forth edge and the plurality of first tray substrate downward tabs located on the first tray substrate forth edge to form an assembled tray substrate comprising the first tray substrate and the second tray substrate.

The flooring component is smaller than a tray surface of the assembled tray substrate defined by the first tray substrate first vertical tray edge, the first tray substrate second vertical tray edge, the first tray substrate third vertical tray edge, the second tray substrate first vertical tray edge, the second tray substrate second vertical tray edge and the second tray substrate third vertical tray edge.

The flooring component is adhered to a tray surface of the assembled tray substrate defined by the first tray substrate surface and the second tray substrate surface with the adhesive.

In one embodiment, the flooring component is selected from the group consisting of tile, stone, marble, wood, ceramic tile, porcelain tile and granite.

In one embodiment, the plurality of first tray substrate upward tabs are located on each of the first tray substrate first edge, the first tray substrate second edge and the first tray substrate third edge. In a further embodiment, the plurality of second tray substrate upward tabs are located on each of the second tray substrate first edge, the second tray substrate second edge and the second tray substrate third edge. In a further embodiment, the plurality of first tray substrate downward tabs are located on each of the first tray substrate first edge, the first tray substrate second edge and the first tray substrate third edge. In a further embodiment, the plurality of second tray substrate downward tabs are located on each of the second tray substrate first edge, the second tray substrate second edge and the second tray substrate third edge.

In one embodiment, the first tray substrate first vertical tray edge runs the entire length of the first tray substrate first edge, the first tray substrate second vertical tray edge runs the entire length of the first tray substrate second edge, the first tray substrate third vertical tray edge runs the entire length of the first tray substrate third edge, the second tray substrate first vertical tray edge runs the entire length of the second tray substrate first edge, the second tray substrate second vertical tray edge runs the entire length of the second tray substrate second edge, and the second tray substrate third vertical tray edge runs the entire length of the second tray substrate third edge.

In one embodiment, the first tray substrate bottom has a padding attached to the first tray substrate bottom. In a further embodiment, the second tray substrate bottom has a padding attached to the first tray substrate bottom.

In one embodiment, the plurality of first tray substrate upward tabs and the plurality of first tray substrate downward tabs alternate on at least one edge of the first tray substrate. In a further embodiment, the plurality of second tray substrate upward tabs and the plurality of second tray substrate downward tabs alternate on at least one edge of the second tray substrate. In another embodiment, the plurality of first tray substrate upward tabs and the plurality of first tray substrate downward tabs alternate on each edge of the first tray substrate. In still another embodiment, the plurality of second tray substrate upward tabs and the plurality of second tray substrate downward tabs alternate on each edge of the second tray substrate.

In one embodiment, the first tray substrate fourth edge comprises more than one hole and at least one upward tab of the plurality of second tray substrate upward tabs located on the second tray substrate fourth edge corresponding with the location of the more than one hole of the first tray substrate fourth edge has a convex surface which extends upwardly by an amount which is greater than the amount that the convex surface of the plurality of upward tabs on the second tray substrate extends upwardly.

In one embodiment, the second tray substrate fourth edge comprises more than one hole and at least one upward tab of the plurality of first tray substrate upward tabs located on the first tray substrate fourth edge corresponding with the location of the more than one hole of the second tray substrate fourth edge has a convex surface which extends upwardly by an amount which is greater than the amount that the convex surface of the plurality of upward tabs on the first tray substrate extends upwardly.

Also disclosed herein is a tray substrate for a flooring system comprising an upward facing horizontal surface, a bottom and a perimeter comprising a first edge comprising a vertical tray edge protruding upward, a second edge comprising a second vertical tray edge protruding upward, a third edge comprising a third vertical tray edge protruding upward, a fourth edge, a plurality of upward tabs located on the forth edge and at least one of the first edge, the second edge and the third edge wherein each of the plurality of upward tabs has a convex surface extending upwardly and a valley, a plurality of downward tabs located on the forth edge and at least one of the first edge, the second edge and the third edge wherein each of the plurality of downward tabs has a concave surface and a lip and a portion of each of the plurality of downward tabs is recessed under the upward facing horizontal surface, a hole passing through the tray substrate from the upward facing horizontal surface to the bottom located along a portion of the forth edge adjacent to the first edge, and an upward end tab located along a portion of the forth edge adjacent to the third edge wherein the upward end tab has a convex surface extending upwardly and a valley wherein the convex surface of the upward end tab extends upwardly by a greater amount than the convex surface of the plurality of upward tabs.

In one embodiment of the tray substrate, the plurality of upward tabs are located on each of the first edge, the second edge and the third edge. In another embodiment of the tray substrate, the plurality of downward tabs are located on each of the first edge, the second edge and the third edge.

In one embodiment of the tray substrate, the first vertical tray edge runs the entire length of the first edge, the second vertical tray edge runs the entire length of the second edge, and the third vertical tray edge runs the entire length of the third edge.

In one embodiment of the tray substrate, the bottom has a padding attached to the bottom.

In one embodiment of the tray substrate the plurality of upward tabs and the plurality of downward tabs alternate on at least one edge of the tray substrate. In another embodiment of the tray substrate, the plurality of upward tabs and the plurality of downward tabs alternate on each edge of the tray substrate.

In one embodiment of the tray substrate, the fourth edge comprises more than one hole. In another embodiment of the tray substrate, at least one of the plurality of upward tabs on the fourth edge comprises a convex surface extending upwardly by a greater amount than the convex surface of the plurality of upward tabs.

DETAILED DESCRIPTION

This specification describes a modular flooring assembly including a rectangular flooring component adhered to two tray substrates, a first tray substrate and a second tray substrate. The two tray substrates may be interconnected with additional modular flooring assemblies to form a modular floor suitable for most flooring applications. The rectangular flooring component may comprise tile or wood or other materials commonly used in flooring applications. The two tray substrates are substantially identical to one another so that, when the two tray substrates are assembled to form an assembled tray substrate, the second tray substrate is rotated 180° in the horizontal plane to interact with the first tray substrate. The two tray substrates comprise vertical tray edges protruding upward from three edges of the tray substrate. A fourth edge of each tray substrate does not contain a vertical tray edge. The two tray substrates are joined at this fourth edge by a plurality of tabs to form an assembled tray substrate comprising the first tray substrate and the second tray substrate. The assembled tray substrates also comprise tabs which provide for the assembled tray substrates to interlock with tabs from adjacent assembled tray substrate(s). The fully assembled modular floor provides the appearance of a conventional floor. Fill-in grout or a snap-in grout may be used with the modular flooring assemblies.

The modular flooring assembly described herein is an improvement over the prior art in that it can be used with flooring components having non-standard sizes and/or shapes, such as large rectangular or plank flooring components. As used herein and in the claims a "rectangular" or "plank" flooring component is defined as a flooring component having a first edge opposite a second edge and a third edge opposite a fourth edge wherein the length of the first edge and the second edge is greater than the length of the third edge and the fourth edge.

The modular floor may be quickly disassembled and does not damage the sub floor, as the modular floor is not typically attached to the sub floor by adhesives, grout components, or other fastening means. Further, the modular floor may be installed over an existing sub floor without the installation of a concrete backer board, which is commonly used in ceramic tile installations.

The assembled tray substrate supports the flooring components on the first tray substrate surface and the second tray substrate surface. The tray surfaces are upward facing horizontal surfaces. The first tray substrate also has a first tray substrate perimeter comprising a first tray substrate first edge, a first tray substrate second edge, a first tray substrate third edge, and a first tray substrate fourth edge. The first tray substrate first edge, the first tray substrate second edge and the first tray substrate third edge each comprises a vertical tray edge which protrudes upward. Similarly, the second tray substrate has a second tray substrate perimeter comprising a second tray substrate first edge, a second tray substrate second edge, a second tray substrate third edge, and a second tray substrate fourth edge. The second tray substrate first edge, the second tray substrate second edge and the second tray substrate third edge each comprises a vertical tray edge which protrudes upward.

The first tray substrate fourth edge comprises a plurality of upward tabs having a convex surface and a valley and a plurality of downward tabs having a concave surface and a lip extending upward. A portion of each of the plurality of first tray substrate downward tabs is recessed under the first tray substrate. The first tray substrate also comprises a hole passing through the first tray substrate from the first tray substrate surface to the first tray substrate bottom. The first tray substrate hole is located along a portion of the first tray substrate fourth edge adjacent to the first tray substrate first edge. One of the first tray substrate fourth edge upward tabs is a first tray substrate upward end tab, and is located on the first tray substrate fourth edge adjacent to the first tray substrate third edge. The first tray substrate upward end tab convex surface extends upward by an amount which is greater than the amount that the convex surface on the plurality of upward tabs extends upward.

Similarly, the second tray substrate fourth edge comprises a plurality of upward tabs having a convex surface and a valley and a plurality of downward tabs having a concave surface and a lip. A portion of each of the plurality of second tray substrate downward tabs is recessed under the second tray substrate. The second tray substrate also comprises a hole passing through the second tray substrate from the second tray substrate surface to the second tray substrate bottom. The second tray substrate hole is located along a portion of the second tray substrate fourth edge adjacent to the second tray substrate first edge. One of the second tray substrate fourth edge upward tabs is a second tray substrate upward end tab, and is located on the second tray substrate fourth edge adjacent to the second tray substrate third edge. The second tray substrate upward end tab convex surface extends upward by an amount which is greater than the amount that the convex surface on the plurality of upward tabs extends upward.

In one embodiment, the first tray substrate fourth edge, the second tray substrate fourth edge or both the first tray substrate fourth edge and the second tray substrate fourth edge comprises more than one hole. In such an embodiment, additional holes may be located in the respective tray substrate fourth edge anywhere along the length of the tray substrate fourth edge spanning from the tray substrate first edge to the tray substrate third edge. When one or both of the tray substrate fourth edge(s) comprises more than one hole, the upward tab(s) located on the fourth edge of the other tray substrate, rotated 180° in the horizontal plane, corresponding with the location of the hole will have a convex surface which extends upward by an amount which is greater than the amount that the convex surface on the plurality of upward tabs extends upwardly.

For example, the first tray substrate fourth edge may comprise two holes, one located along a portion of the first tray substrate fourth edge adjacent to the first tray substrate first edge and a second located along a portion of the first tray substrate fourth edge at or near the center point of the first tray substrate fourth edge. In such an embodiment, the second tray substrate fourth edge comprises a second tray substrate upward end tab located on the second tray substrate fourth edge adjacent to the second tray substrate third edge having a convex surface which extends upward by an amount greater than the amount that the convex surface on the plurality of upward tabs extends upwardly. In such an embodiment, the upward tab of the plurality of upward tabs on the second tray substrate fourth edge located at or near the center point of the second tray substrate fourth edge also has a convex surface which extends upward by an amount greater than the amount that the convex surface on the rest of the plurality of upward tabs extends upwardly.

The first tray substrate and the second tray substrate are substantially identical to one another so that, when the two tray substrates are assembled to form an assembled tray substrate, the second tray substrate is rotated 180° in the horizontal plane to interact with the first tray substrate. In the assembled tray substrate, the first tray substrate and the second tray substrate are connected to one another along the first tray substrate fourth edge and the second tray substrate fourth edge. The first tray substrate and the second tray substrate are connected by a series of interactions between the upward tabs, the downward tabs and the holes located on the first tray substrate fourth edge and the second tray substrate fourth edge respectively. The first tray substrate hole interacts with the second tray substrate upward end tab with the convex surface of the second tray substrate upward end tab protruding into the first tray substrate hole. The second tray substrate hole interacts with the first tray substrate upward end tab with the convex surface of the first tray substrate upward end tab protruding into the second tray substrate hole. The remainder of the plurality of first tray substrate upward tabs located on the first tray substrate fourth edge interact with the remainder of the plurality of second tray substrate downward tabs located on the second tray substrate fourth edge. Finally, the remainder of the plurality of second tray substrate upward tabs located on the second tray substrate fourth edge interact with the remainder of the plurality of first tray substrate downward tabs located on the first tray substrate fourth edge. When the first tray substrate and the second tray substrate are connected they form an assembled tray substrate comprising the first tray substrate and the second tray substrate. The first tray substrate upward end tab and the second tray substrate end tab having the convex surface extended upwardly by a greater amount allows the respective end tabs to protrude into their respective holes which secures the connection between the first tray substrate and the second tray substrate and helps to prevent the assembled tray substrate from disassembling during handling, such as when the flooring component is attached to the assembled tray substrate.

The first tray substrate upward tabs, the first tray substrate downward tabs, the first tray substrate hole, the first tray substrate upward end tab, the second tray substrate upward tabs, the second tray substrate downward tabs, the second tray substrate hole and the second tray substrate upward end tab may be thought of as internal connectors which lock the first tray substrate to the second tray substrate. The internal connectors differ from the upward tabs and downward tabs located on the first edge, the second edge and the third edge of the first tray substrate and the second tray substrate, which can be thought of as external connectors which connect one assembled tray substrate to another assembled tray substrate.

The flooring component is attached to the tray surface with an adhesive. Each tray surface may be generally flat, or may contain a pattern designed to enhance adhesive performance between the tray surfaces and the rectangular flooring component. The pattern may be designed to complement the bottom of the flooring component; for example, tiles may have different mold patterns on their bottom depending upon the manufacturer's design. The tray surfaces may also be solid, or may have holes therein. The holes may be added in appropriate locations to aid in moisture evaporation without compromising adhesive performance.

The vertical tray edges are designed to ensure substantially exact, or exact, alignment of the flooring component with the tray surface, and help provide a barrier to ensure the adhesive can be applied over the entire bottom of the flooring component without the adhesive being pushed or flowing into the tab areas. If adhesive is allowed to enter the tab areas, their interlocking connection may be physically impaired by adhesive residue. When the two tray substrates are assembled, the inside of the vertical tray edges define an area smaller than the perimeter of the two assembled tray substrates. The vertical tray edges do not have to run the entire perimeter of the assembled tray substrate, but preferably should run the entire perimeter of the assembled tray substrates. The flooring component is set inside the wall defined by the vertical tray edges of the assembled tray substrates and is adhered to the tray surfaces defined by the inside wall of the vertical tray edges of the assembled tray substrates.

By their vertical orientation, the vertical tray edges of the assembled tray substrates positionally hold the flooring component and, in combination with the adhesive, reduce lateral movement. The inside wall of the vertical tray edges may provide a further surface for the adhesive to adhere the side of the flooring component. The tray surfaces join to the bottom of the flooring component via the adhesive and the inside wall of the vertical tray edges join to the sides of the flooring component via the adhesive. The combination of the adhesive on the tray surfaces and the adhesive on the inside wall of the tray edges provides a secure hold for the flooring component. This ensures that the flooring component is locked down to the tray substrates, and the flooring component does not slip or move.

The size of the tray substrates and the flooring component are strictly controlled to insure that the flooring component fits securely in the assembled tray substrates. The flooring component should just fit onto the tray surfaces when the two tray substrates are assembled and rest snugly against the inside wall of the vertical tray edges. The flooring component should be slightly smaller than the tray surface defined by the vertical tray edges.

There are upward and downward facing tabs located on at least one of the first tray substrate edge, the second tray substrate edge and the third tray substrate edge of each of the tray substrates. These upward and downward facing tabs are the external connectors which connect one assembled tray substrate to another assembled tray substrate. Preferably, the upward and downward facing tabs are located on each of the first tray substrate edge, the second tray substrate edge and the third tray substrate edge of each of the tray substrates. The upward and downward orientation is based upon the tray bottom and the upward facing tray surface. The upward and downward tabs should, but do not have to alternate on at least one edge of the assembled tray substrate. In one embodiment, the upward and downward tabs may alternate on each edge of the assembled tray substrate. For example, there could be two downward tabs, one upward tab and two downward tabs. For most flooring applications, the use of 6, 8, or 10 tabs (half of which are upward tabs and half of which are downward tabs) per assembled tray substrate edge provide satisfactory performance. In other embodiments, there may be fewer or additional tabs. Preferably, the number of tabs per assembled tray substrate edge is in multiples of four.

Each upward tab comprises a surface and a valley. The shape of the surface could be convex or flat or spiked. Each downward tab includes a surface and a lip. The shape of the surface may be concave. As the downward tab is urged against the upward tab, the upward tab flexes as the lip slides over the convex surface and into the valley, such that the lip snaps into the valley and the concave surface presses over the convex surface. This provides a connection with sufficient rigidity to create a composite floor made of multiple modular flooring assemblies.

In order to provide a narrower gap between two of the assembled tray substrates, which also provides for a narrower grout line, the downward facing tab does not extend from the side of the tray substrates. Rather, the downward tab extends from a recessed area in the side of the tray substrates. The length of the recessed area as measured along the side of the tray substrates is at least slightly longer than the upward facing tab so that the upward facing tab can fit into the recessed area and under the tray surface, and that at least a portion of the valley of the downward tab is aligned underneath the horizontal tray surfaces. Alternatively stated, at least a portion of the downward tab is recessed under the tray surfaces. In one embodiment, a portion of the lip of the downward tab is directly beneath the vertical tray edge with the valley underneath the horizontal tray surface. In one embodiment, the entire downward tab is recessed under the tray surfaces. In another embodiment only the upward facing tab is partially or entirely recessed into the tray edge. In yet another embodiment, both the upward and downward facing tabs are partially or entirely recessed into the tray edge or underneath the horizontal surface.

In an alternative embodiment having a wider gap between two of the assembled tray substrates, which provides for a wider grout line, the downward tabs extend from the side of the tray substrates and the upward tabs also extend from the side of the tray substrates. Embodiments having partially or entirely recessed upward and/or downward tabs on one edge of the assembled tray substrate with non-recessed upward and/or downward tabs on another edge of the assembled tray substrate to provide for narrower gaps and grout lines on one side and wider gaps and grout lines on another side are also conceived.

The modular flooring assembly is designed such that, even if one or more tabs are broken on a given side, the tray substrates will still interlock adjacent tray substrates. This also allows the modular flooring assemblies to be cut to a specific size and to still interlock.

The interlocking tabs may be positioned such that the modular flooring assemblies are offset supporting various decorative patterns.

The interlocking tabs on one modular flooring assembly need not be perfectly aligned with the other modular flooring assembly to allow "fine-tuning" of the relative flooring component position.

The bottom of the tray (i.e. opposite of the tray surface) is designed as the foundation of the system. The bottom may include structural webbing to strengthen the tray bottom ensuring the tray surface remains relatively flat.

The bottom of the trays may also include an optional non-skid and noise deadening padding of an over-molded, rubber-like material, such as thermoplastic rubber or thermoplastic elastomer. A particularly preferred thermoplastic elastomer is SANTOPRENE®. The padding provides a cushion for the flooring system. The padding also provides a non-skid element that prevents the flooring system from sliding on the underlying flooring material. The padding also provides some level of flex in the presence of underlying floor surface imperfections or heavy surface loads. The padding also helps reduce vibration transmission, thus providing a sound-deadening function. This padding may be adhered to the trays or overmolded.

As described above, various types of grout may be used in the present invention, including the snap-in grout or a fill-in grout compound that is spread into the gaps between adjacent trays.

Fill-in grouts may also be used with the trays. Fill-in grouts may be packaged in a powdered or granular form. The user mixes the powder or granules with a liquid to form a plastic material that is spread in between the modular flooring assemblies. Other fill-in grout compounds are packaged in a ready to spread form. The modular flooring assemblies are snapped together and the fill-in grout material is used to fill the space between the modular flooring assembly. The fill-in grout material must remain semi-flexible once cured since the floor "floats". The separate grout material must also have good adhesive qualities to ensure the material adheres to the sides of the modular flooring assemblies. Acrylic, urethane, epoxy, and latex modified grouts are suitable.

By using a snap-in grout that is not permanently integrated with the tray, consumers may choose from among many different snap-in grout colors. Damaged snap-in grout can be easily replaced. Snap-in grout may also be changed to reflect different decorating tastes. Like fill-in grout, flexibility is provided by using snap-in grout.

The flooring component may comprise tile, stone, marble, wood, or other conventional flooring materials. The flooring component could be a ceramic or porcelain tile, a natural stone product like marble or granite, or could be a wooden product.

The flooring component is adhered to the surface of the assembled trays and the inner wall of the vertical tray edges of the assembled trays using a variety of commercially available adhesives. Suitable adhesives for use with the present invention include a two-part epoxy using a methacrylate material, silicone, rubber based and urethane based adhesives. The specific selection of the adhesive will depend on the nature and properties of the flooring component. The methacrylate adhesive is preferred for ceramic tile.

Multiple adhesive materials and application patterns can be used depending upon the combination of plastic resin used for the tray, the flooring material, and the profile of the flooring material. For tile applications, adhesive is applied to the ridgelines on the bottom of the tile to maximize contact with the tray surface. Robotics may be used to improve the precision and efficiency of the assembly process. Robotics may also be used to package and palletize the finished products.

The trays may be made using injection molding of a suitable plastic resin. High impact polystyrene is preferred, but other plastic resins include, nylon/polyamides, polypropylene and acrylobutadiene styrene (ABS) may be used.

The modular flooring assemblies of the present invention may be used in almost any sized rectangular or plank embodiment, including 6 inch (16.24 cm) by 24 inch (60.96 cm). The modular flooring assemblies may be further modified to include other combinations of different sized flooring components.

During use, the modular flooring assemblies are snapped together to form an overall flooring surface. The fill-in grout material may be applied between the modular flooring assemblies, or the snap-in grout may be installed. In order to accommodate different rooms of varying sizes and shapes, the modular flooring assemblies can be cut using a wet saw if tile or stone is the flooring component or using a table or circular saw for wooden flooring components.

The underlying flooring surface should be free of major surface variations, but need not be in perfect condition. No special floor preparation is required to ensure the tiles are fixed since the interlocking modular flooring assemblies will "float" and flex. The system can be installed directly on top of finished wood, linoleum, other tile, concrete, plywood, or a variety of other flooring systems. The modular flooring assemblies can be installed on top of padding or other underlayment material if an additional measure of insulation or padding is desired. The modular flooring assemblies can be installed on top of radiant-type heating systems as well.

The modular flooring assemblies will now be described with reference to the Figures where like numbers refer to like components in other figures. Each time a component is mentioned, its number is used so if it is not present in a given figure it can be found in another figure.

FIG. 1 is a perspective view of a first tray substrate 100 and a second tray substrate 200. The first tray substrate 100 has a first tray substrate upward facing horizontal surface 110 and a first tray substrate bottom 120. The second tray substrate 100 has a second tray substrate upward facing horizontal surface 210 and a second tray substrate bottom 220.

As shown in FIG. 1, the first tray substrate also has a first tray substrate first edge 130, a first tray substrate second edge 140, a first tray substrate third edge 150 and a first tray substrate fourth edge 160. The first tray substrate first edge 130 has a first tray substrate first vertical tray edge 135. The first tray substrate second edge 140 has a first tray substrate second vertical tray edge 145. The first tray substrate third edge 150 has a first tray substrate third vertical tray edge 155. The first tray substrate first vertical tray edge 135, the first tray substrate second vertical tray edge 145 and the first tray substrate third vertical tray edge 155 are preferably shorter than the height of a flooring sample (not pictured in FIG. 1). The first tray substrate first edge 130, the first tray substrate second edge 140, the first tray substrate third edge 150 and the first tray substrate fourth edge 160 each comprise a plurality of upward tabs 300A and a plurality of downward tabs 400A.

As shown in FIG. 1, the second tray substrate also has a second tray substrate first edge 230, a second tray substrate second edge 240, a second tray substrate third edge 250 and a second tray substrate fourth edge 260. The second tray substrate first edge 230 has a second tray substrate first vertical tray edge 235. The second tray substrate second edge 240 has a second tray substrate second vertical tray edge 245. The second tray substrate third edge 250 has a second tray substrate third vertical tray edge 255. The second tray substrate first vertical tray edge 235, the second tray substrate second vertical tray edge 245 and the second tray substrate third vertical tray edge 255 are preferably shorter than the height of a flooring sample (not pictured in FIG. 1). The second tray substrate first edge 230, the second tray substrate second edge 240, the second tray substrate third edge 150 and the second tray substrate fourth edge 260 each comprises a plurality of upward tabs 300B and a plurality of downward tabs 400B.

Figure 2:
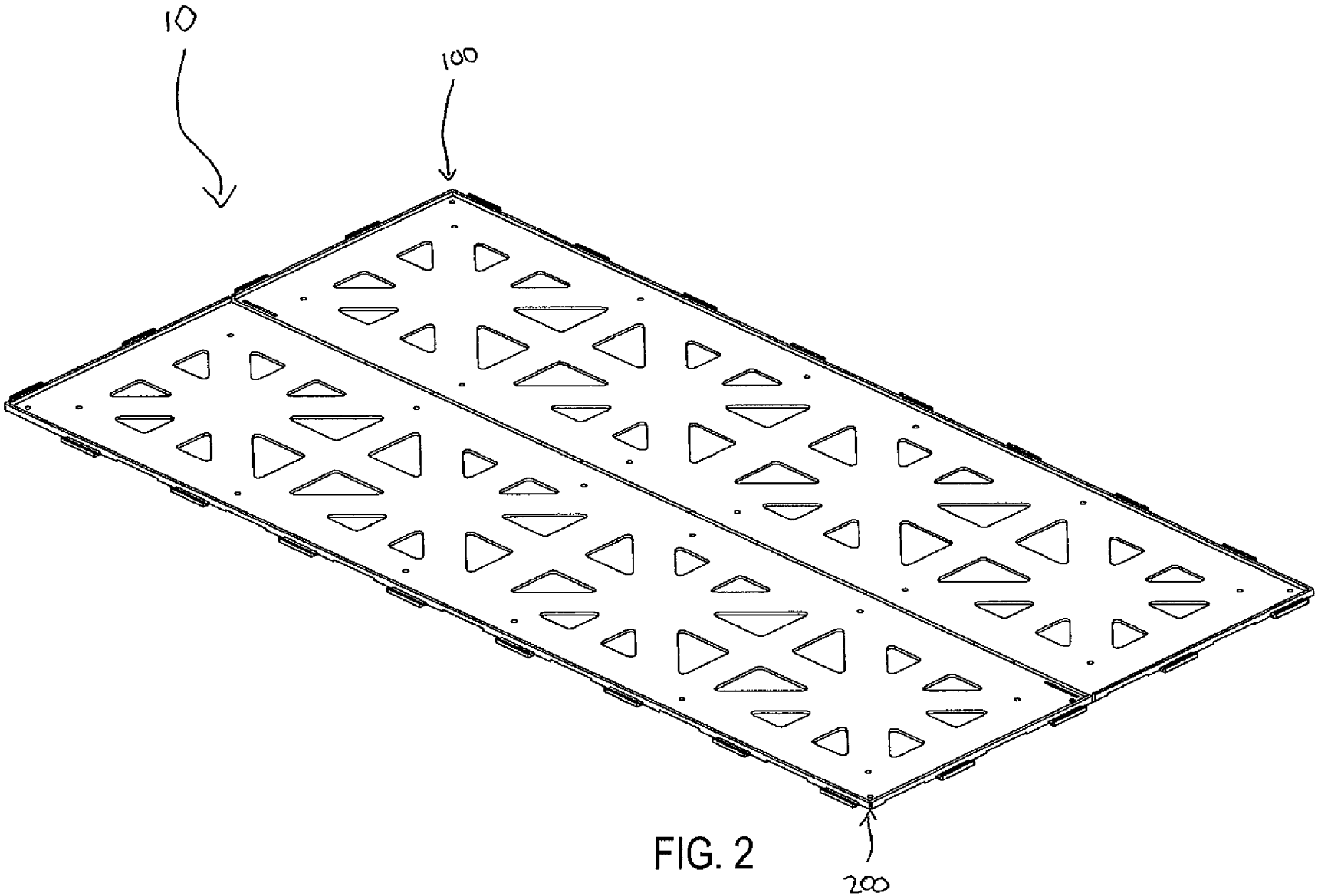
FIG. 2 is a perspective view of an assembled tray substrate.

FIG. 2 is a perspective view of an assembled tray substrate 10 comprising the first tray substrate 100 and the second tray substrate 200.

Figure 3:
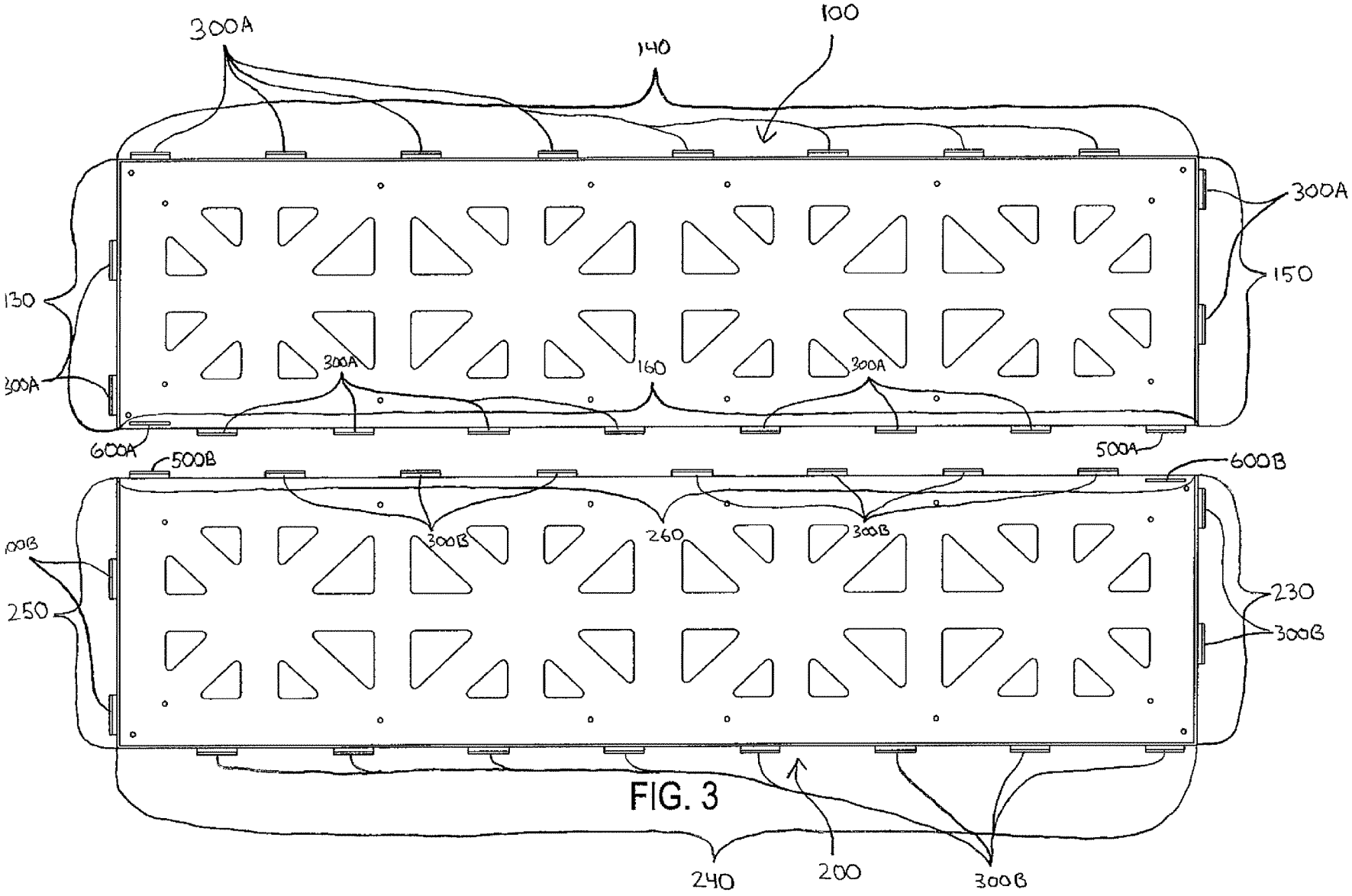
FIG. 3 is a top view of a first tray substrate and a second tray substrate.

FIG. 3 is a top view of a first tray substrate 100 and a second tray substrate 200. The first tray substrate 100 has a first tray substrate first edge 130, a first tray substrate second edge 140, a first tray substrate third edge 150 and a first tray substrate fourth edge 160. The second tray substrate 200 has a second tray substrate first edge 230, a second tray substrate second edge 240, a second tray substrate third edge 250 and a second tray substrate fourth edge 260.

As shown in FIG. 3, the first tray substrate first edge 130, the first tray substrate second edge 140, the first tray substrate third edge 150 and the first tray substrate fourth edge 160 each comprises a plurality of upward tabs 300A. There are a plurality of downward tabs (not pictured in FIG. 3) located in an alternating fashion between the plurality of upward tabs 300A. The first tray substrate fourth edge 160 further contains a first tray substrate hole 600A located along the first tray substrate fourth edge adjacent to the first tray substrate first edge 130. The first tray substrate fourth edge 160 further contains a first tray substrate upward end tab 500A located along the first tray substrate fourth edge adjacent to the first tray substrate third edge 150.

As also shown in FIG. 3, the second tray substrate first edge 230, the second tray substrate second edge 240, the second tray substrate third edge 250 and the second tray substrate fourth edge 260 each comprises a plurality of upward tabs 300B. There are a plurality of downward tabs (not pictured in FIG. 3) located in an alternating fashion between the plurality of upward tabs 300B. The second tray substrate fourth edge 260 further contains a second tray substrate hole 600B located along the second tray substrate fourth edge adjacent to the second tray substrate first edge 230. The second tray substrate fourth edge 260 further contains a second tray substrate upward end tab 500B located along the second tray substrate fourth edge adjacent to the second tray substrate third edge 250.

Figure 4:
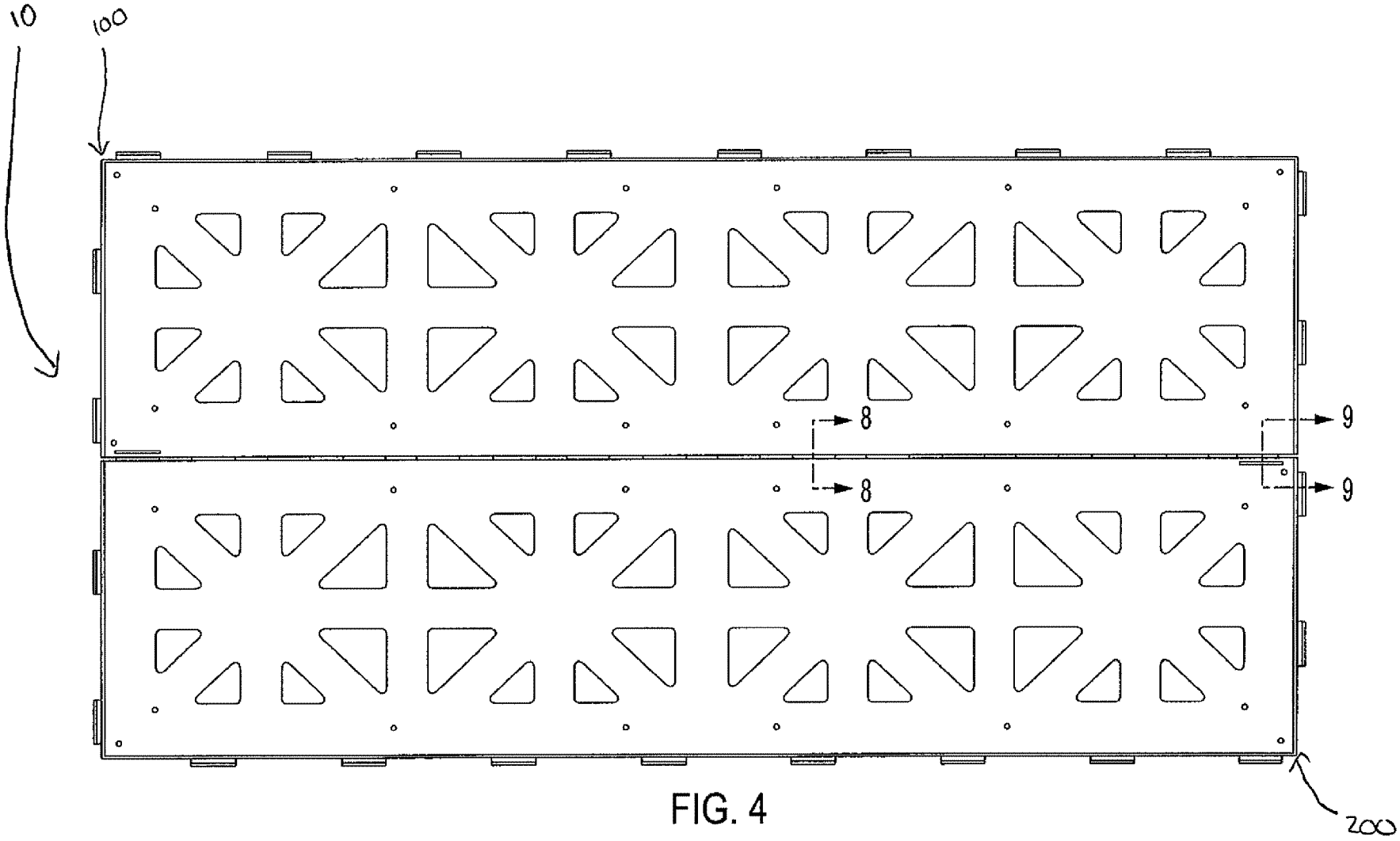
FIG. 4 is a top view of an assembled tray substrate.

FIG. 4 is a top view of an assembled tray substrate 10 comprising the first tray substrate 100 and the second tray substrate 200.

Figure 5:
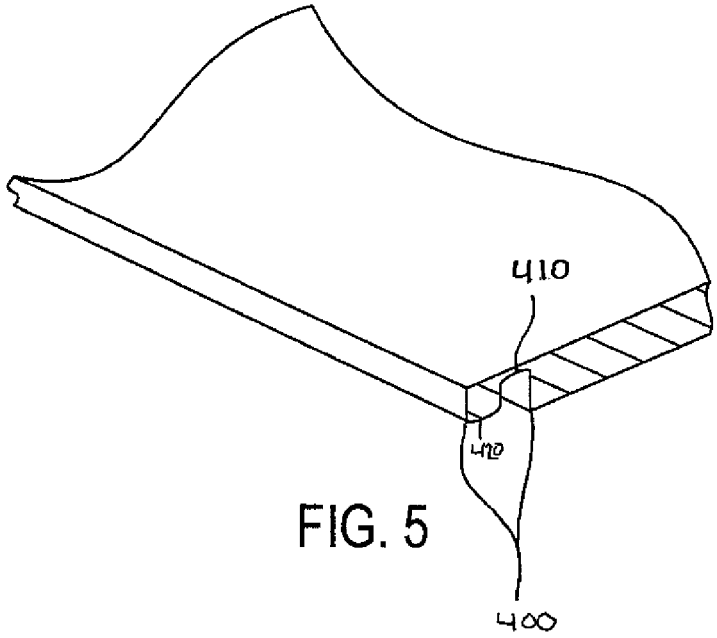
FIG. 5 is a perspective view of a downward tab.

FIG. 5 is a perspective view of a downward tab 400. As shown in FIG. 5, the downward tab 400 includes a concave surface 410 and a lip 420.

Figure 6:
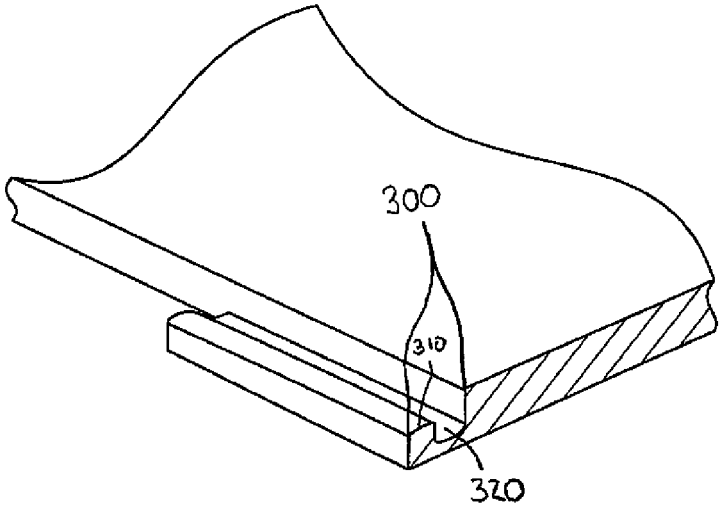
FIG. 6 is a perspective view of an upward tab.

FIG. 6 is a perspective view of an upward tab 300. As shown in FIG. 6, the upward tab 300 includes a convex surface 310 and a valley 320.

Figure 7:
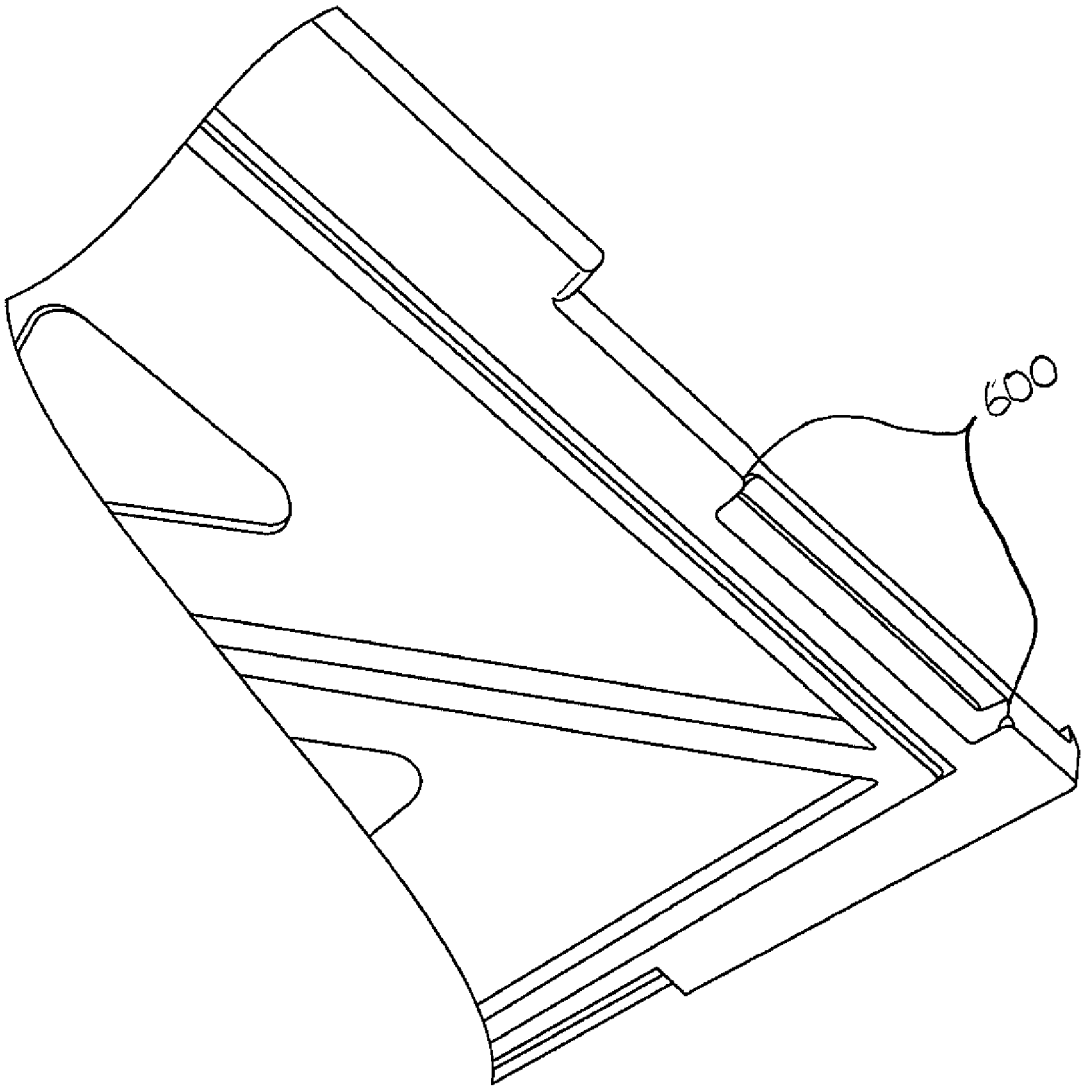
FIG. 7 is a perspective view of a hole.

FIG. 7 is a perspective view of a hole 600. The hole may be a first tray substrate hole or a second tray substrate hole, as the first tray substrate hole is substantially identical to the second tray substrate hole.

Figure 8:
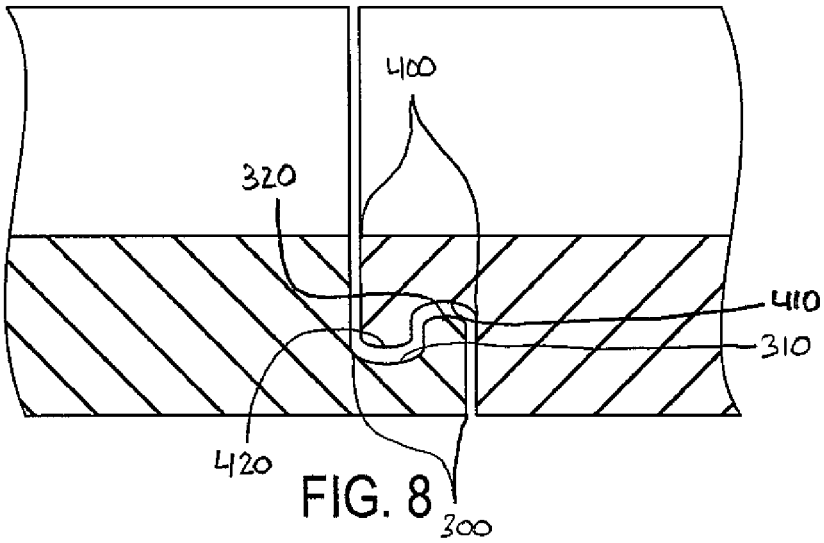
FIG. 8 is a cross section view of a downward tab interacting with an upward tab.

FIG. 8 is a cross sectional view of an upward tab 300 interacting with a downward tab 400. As the downward tab 400 is urged against the upward tab 300, the downward tab 400 flexes as the lip 420 slides over the convex surface 310 and into the valley 320, such that the lip 420 snaps into the valley 320 and the concave surface 410 presses over the convex surface 310.

Figure 9:
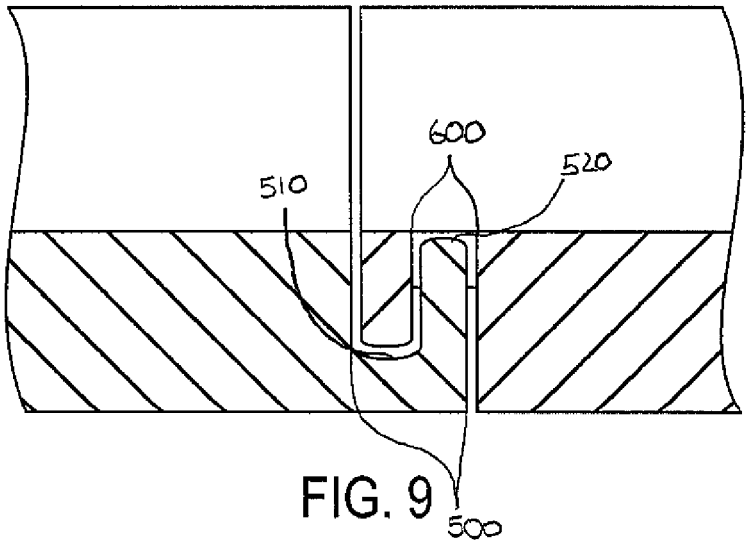
FIG. 9 is a cross section view of an upward end tab interacting with a hole.

FIG. 9 is a cross sectional view of an upward end tab 500 interacting with a hole 600. The upward end tab may be a first tray substrate upward end tab or a second tray substrate upward end tab, as the first tray substrate upward end tab is substantially identical to the second tray substrate upward end tab. The hole may be a first tray substrate hole or a second tray substrate hole, as the first tray substrate hole is substantially identical to the second tray substrate hole. The upward end tab 500 includes a concave surface 510 and a valley 520. As shown in FIG. 9, the upward end tab concave surface 510 extends upwardly by a greater amount than the upward tab concave surface 310 (shown in FIG. 8) allowing the upward end tab concave surface 510 to fit into the hole 600. The configuration shown in FIG. 9 having an upward tab having a concave surface extending upwardly by a greater amount can be used in embodiments having more than one hole in the first tray substrate fourth edge and/or the second tray substrate fourth edge.

Figure 10:
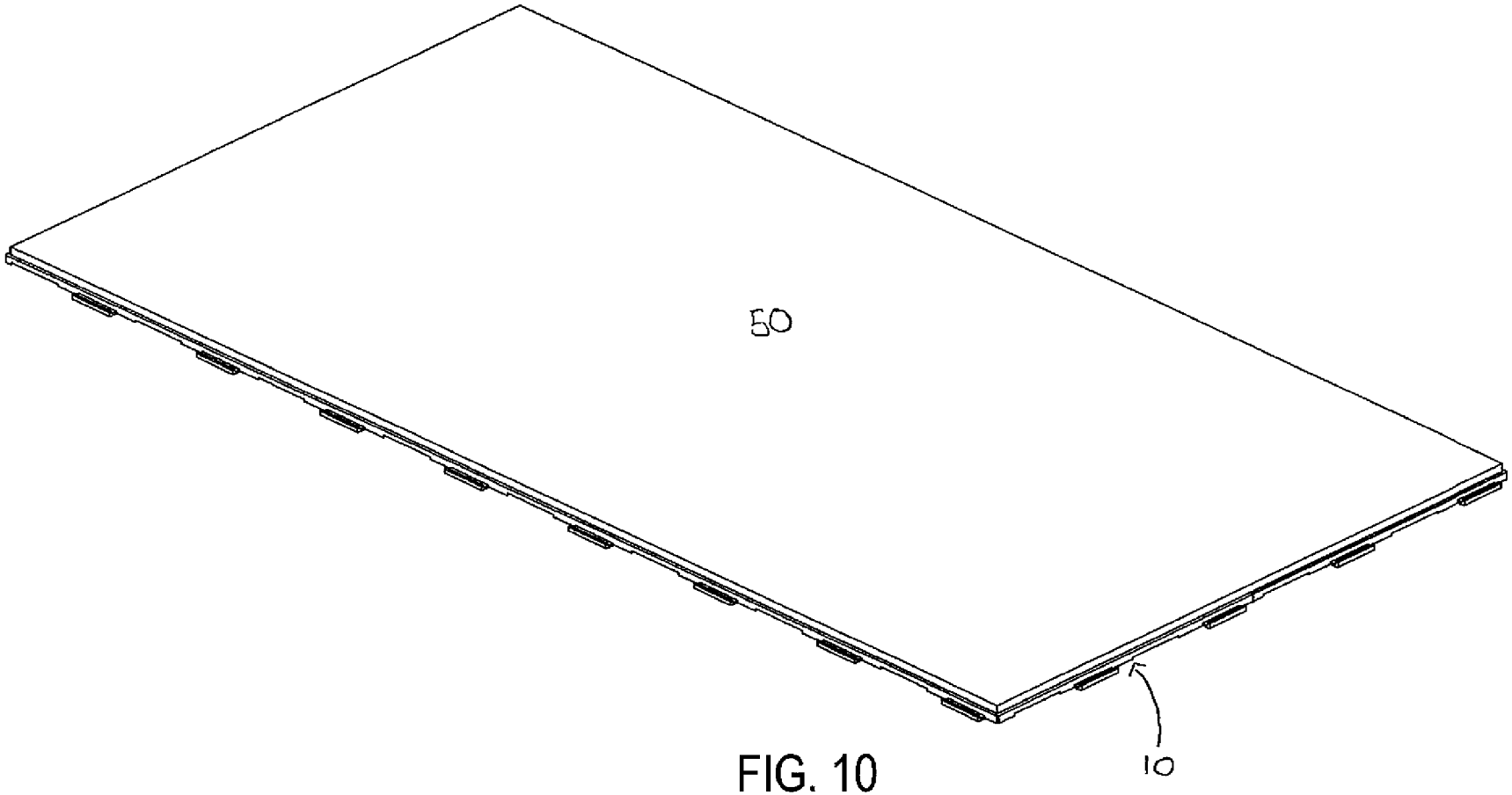
FIG. 10 is a perspective view of an assembled tray substrate including a flooring component.

FIG. 10 is a perspective view of an assembled tray substrate 10 showing a flooring component 50 fitting onto the tray surface. The tray surface that the flooring component fits onto is defined, as shown in FIG. 2, by the first tray substrate first vertical tray edge 135, the first tray substrate second vertical tray edge 145, the first tray substrate third vertical tray edge 155, the second tray substrate first vertical tray edge 235, the second tray substrate second vertical tray edge 245 and the second tray substrate third vertical tray edge 255.

We claim:

1. A component of a flooring system comprising:

a flooring component, an adhesive, a first tray substrate having a first tray substrate upward facing horizontal surface, a first tray substrate bottom, a first tray substrate perimeter comprising a first tray substrate first edge comprising a first tray substrate first vertical tray edge protruding upward, a first tray substrate second edge comprising a first tray substrate second vertical tray edge which protrudes upward, a first tray substrate third edge comprising a first tray substrate third vertical tray edge which protrudes upward, a first tray substrate fourth edge, a plurality of first tray substrate upward tabs located on the first tray substrate fourth edge and at least one of the first tray substrate first edge, the first tray substrate second edge and the first tray substrate third edge wherein each of the plurality of first tray substrate upward tabs has a convex surface extending upwardly and a valley, a plurality of first tray substrate downward tabs located on the first tray substrate fourth edge and at least one of the first tray substrate first edge, the first tray substrate second edge and the first tray substrate third edge wherein each of the plurality of first tray substrate downward tabs has a concave surface and a lip and a portion of each of the plurality of first tray substrate downward tabs is recessed under the first tray substrate upward facing horizontal tray surface, a first tray substrate hole passing through the first tray substrate from the first tray substrate surface to the first tray substrate bottom located along a portion of the first tray substrate fourth edge adjacent to the first tray substrate first edge, and a first tray substrate upward end tab located along a portion of the first tray substrate fourth edge adjacent to the first tray substrate third edge wherein the first tray substrate upward end tab has a convex surface extending upwardly and a valley wherein the convex surface of the first tray substrate upward end tab extends upwardly by a greater amount than the convex surface of the plurality of first tray substrate upward tabs;

a second tray substrate having a second tray substrate upward facing horizontal surface, a second tray substrate bottom, a second tray substrate perimeter comprising a second tray substrate first edge comprising a second tray substrate first vertical tray edge which protrudes upward, a second tray substrate second edge comprising a second tray substrate second vertical tray edge which protrudes upward, a second tray substrate third edge comprising a second tray substrate third vertical tray edge which protrudes upward, a second tray substrate fourth edge, a plurality of second tray substrate upward tabs located on at least one of the second tray substrate first edge, the second tray substrate second edge and the second tray substrate third edge wherein each of the plurality of second tray substrate upward tabs has a convex surface extending upwardly and a valley, a plurality of second tray substrate downward tabs located on the second tray substrate fourth edge and at least one of the second tray substrate first edge, the second tray substrate second edge and the second tray substrate third edge wherein each of the plurality of second tray substrate downward tabs has a concave surface and a lip and a portion of each of the plurality of second tray substrate downward tabs is recessed under the second tray substrate upward facing horizontal tray surface, a second tray substrate hole passing through the second tray substrate from the second tray substrate surface to the second tray substrate bottom located along a portion of the second tray substrate fourth edge adjacent to the second tray substrate first edge, and a second tray substrate upward end tab located along a portion of the second tray substrate fourth edge adjacent to the second tray substrate third edge wherein the second tray substrate upward end tab has a convex surface extending upwardly and a valley wherein the convex surface of the second tray substrate upward end tab extends upwardly by a greater amount than the convex surface of the plurality of second tray substrate upward tabs;

wherein the first tray substrate is connected to the second tray substrate by an interaction between the first tray substrate hole and the second tray substrate upward end tab, an interaction between the second tray substrate hole and a first tray substrate upward end tab, an interaction between the plurality of first tray substrate upward tabs located on the first tray substrate fourth edge and the plurality of second tray substrate downward tabs located on the second tray substrate fourth edge, and an interaction between the plurality of second tray substrate upward tabs located on the second tray substrate fourth edge and the plurality of first tray substrate downward tabs located on the first tray substrate fourth edge to form an assembled tray substrate comprising the first tray substrate and the second tray substrate, the flooring component is smaller than a tray surface of the assembled tray substrate defined by the first tray substrate first vertical tray edge, the first tray substrate second vertical tray edge, the first tray substrate third vertical tray edge, the second tray substrate first vertical tray edge, the second tray substrate second vertical tray edge and the second tray substrate third vertical tray edge, and the flooring component is adhered to a tray surface of the assembled tray substrate defined by the first tray substrate surface and the second tray substrate surface with the adhesive.

2. The component of a flooring system of claim 1, wherein the flooring component is selected from the group consisting of tile, stone, marble, wood, ceramic tile, porcelain tile and granite.

3. The component of a flooring system of claim 1, wherein the plurality of first tray substrate upward tabs are located on each of the first tray substrate first edge, the first tray substrate second edge and the first tray substrate third edge.

4. The component of a flooring system of claim 1, wherein the plurality of second tray substrate upward tabs are located on each of the second tray substrate first edge, the second tray substrate second edge and the second tray substrate third edge.

5. The component of a flooring system of claim 1, wherein the plurality of first tray substrate downward tabs are located on each of the first tray substrate first edge, the first tray substrate second edge and the first tray substrate third edge.

6. The component of a flooring system of claim 1, wherein the plurality of second tray substrate downward tabs are located on each of the second tray substrate first edge, the second tray substrate second edge and the second tray substrate third edge.

7. The component of a flooring system of claim 1, wherein the first tray substrate first vertical tray edge runs the entire length of the first tray substrate first edge, the first tray substrate second vertical tray edge runs the entire length of the first tray substrate second edge, the first tray substrate third vertical tray edge runs the entire length of the first tray substrate third edge, the second tray substrate first vertical tray edge runs the entire length of the second tray substrate first edge, the second tray substrate second vertical tray edge runs the entire length of the second tray substrate second edge, and the second tray substrate third vertical tray edge runs the entire length of the second tray substrate third edge.

8. The component of a flooring system of claim 1, wherein the plurality of first tray substrate upward tabs and the plurality of first tray substrate downward tabs alternate on at least one edge of the first tray substrate.

9. The component of a flooring system of claim 1, wherein the plurality of second tray substrate upward tabs and the plurality of second tray substrate downward tabs alternate on at least one edge of the second tray substrate.

10. The component of a flooring system of claim 1, wherein the plurality of first tray substrate upward tabs and the plurality of first tray substrate downward tabs alternate on each edge of the first tray substrate.

11. The component of a flooring system of claim 1, wherein the plurality of second tray substrate upward tabs and the plurality of second tray substrate downward tabs alternate on each edge of the second tray substrate.

12. The component of a flooring system of claim 1, wherein the first tray substrate fourth edge comprises more than one hole and at least one upward tab of the plurality of second tray substrate upward tabs located on the second tray substrate fourth edge corresponding with the location of the more than one hole of the first tray substrate fourth edge has a convex surface which extends upwardly by an amount which is greater than the amount that the convex surface of the plurality of upward tabs on the second tray substrate extends upwardly.

13. The component of a flooring system of claim 1, wherein the second tray substrate fourth edge comprises more than one hole and at least one upward tab of the plurality of first tray substrate upward tabs located on the first tray substrate fourth edge corresponding with the location of the more than one hole of the second tray substrate fourth edge has a convex surface which extends upwardly by an amount which is greater than the amount that the convex surface of the plurality of upward tabs on the first tray substrate extends upwardly.

14. A tray substrate for a flooring system comprising:

an upward facing horizontal surface, a bottom, a perimeter comprising a first edge comprising a first vertical tray edge protruding upward, a second edge comprising a second vertical tray edge protruding upward, a third edge comprising a third vertical tray edge protruding upward, a fourth edge, a plurality of upward tabs located on the forth edge and at least one of the first edge, the second edge and the third edge wherein each of the plurality of upward tabs has a convex surface extending upwardly and a valley, a plurality of downward tabs located on the forth edge and at least one of the first edge, the second edge and the third edge wherein each of the plurality of downward tabs has a concave surface and a lip and a portion of each of the plurality of downward tabs is recessed under the upward facing horizontal surface, a hole passing through the tray substrate from the upward facing horizontal surface to the bottom located along a portion of the forth edge adjacent to the first edge, and an upward end tab located along a portion of the forth edge adjacent to the third edge wherein the upward end tab has a convex surface extending upwardly and a valley wherein the convex surface of the upward end tab extends upwardly by a greater amount than the convex surface of the plurality of upward tabs.

15. The tray substrate of claim 14, wherein the plurality of upward tabs are located on each of the first edge, the second edge and the third edge.

16. The tray substrate of claim 14, wherein the plurality of downward tabs are located on each of the first edge, the second edge and the third edge.

17. The tray substrate of claim 14, wherein the first vertical tray edge runs the entire length of the first edge, the second vertical tray edge runs the entire length of the second edge, and the third vertical tray edge runs the entire length of the third edge.

18. The tray substrate of claim 14, wherein the plurality of upward tabs and the plurality of downward tabs alternate on at least one edge of the tray substrate.

19. The tray substrate of claim 14, wherein the plurality of upward tabs and the plurality of downward tabs alternate on each edge of the tray substrate.

20. The tray substrate of claim 14, wherein at least one of the plurality of upward tabs on the fourth edge comprises a convex surface extending upwardly by a greater amount than the convex surface of the plurality of upward tabs.

* * * * *